US009419340B2

(12) United States Patent
Pan

(10) Patent No.: US 9,419,340 B2
(45) Date of Patent: Aug. 16, 2016

(54) ULTRA WIDE BAND ANTENNA

(75) Inventor: Sheng-gen Pan, Kamp-Lintfort (DE)

(73) Assignee: TE Connectivity Germany GmbH, Bensheim (DE)

( * ) Notice: Subject to any disclaimer, the term of this patent is extended or adjusted under 35 U.S.C. 154(b) by 115 days.

(21) Appl. No.: 13/251,956

(22) Filed: Oct. 3, 2011

(65) Prior Publication Data

US 2012/0081252 A1 Apr. 5, 2012

(30) Foreign Application Priority Data

Oct. 4, 2010 (EP) ..... 10013277

(51) Int. Cl.

| | |
|---|---|
| ***H01Q 9/04*** | (2006.01) |
| ***H01Q 1/48*** | (2006.01) |
| ***H01Q 7/00*** | (2006.01) |
| ***B05D 5/12*** | (2006.01) |
| ***H01Q 9/42*** | (2006.01) |
| ***H01Q 5/371*** | (2015.01) |
| ***H01Q 1/36*** | (2006.01) |
| ***H01Q 21/30*** | (2006.01) |

(52) U.S. Cl.

CPC . *H01Q 9/42* (2013.01); *H01Q 1/36* (2013.01); *H01Q 5/371* (2015.01); *H01Q 9/0414* (2013.01); *H01Q 21/30* (2013.01)

(58) Field of Classification Search

CPC ..... H01Q 21/30; H01Q 5/371; H01Q 9/42; H01Q 9/0414

USPC ..... 343/733, 700 MS

See application file for complete search history.

(56) References Cited

U.S. PATENT DOCUMENTS

| | | | | |
|---|---|---|---|---|
| 6,414,637 | B2 * | 7/2002 | Keilen | 343/700 MS |
| 6,900,770 | B2 * | 5/2005 | Apostolos | 343/725 |
| 7,132,985 | B2 * | 11/2006 | Lin | 343/700 MS |
| 2006/0071871 | A1 | 4/2006 | Tang et al. | |
| 2007/0018896 | A1 * | 1/2007 | Chen | H01Q 1/2266 343/702 |
| 2008/0111745 | A1 * | 5/2008 | Takada et al. | 343/700 MS |
| 2008/0150823 | A1 * | 6/2008 | Mohammadian et al. | 343/795 |
| 2008/0180333 | A1 * | 7/2008 | Martiskainen et al. | 343/722 |
| 2008/0266186 | A1 * | 10/2008 | Tai | 343/700 MS |
| 2009/0303136 | A1 * | 12/2009 | Kuramoto et al. | 343/702 |
| 2011/0148724 | A1 * | 6/2011 | Ogawa | 343/767 |

FOREIGN PATENT DOCUMENTS

| | | | | |
|---|---|---|---|---|
| EP | 1939984 | A1 | 7/2008 | |
| EP | 2034555 | A1 | 3/2009 | |
| WO | WO 2010023832 | A1 * | 3/2010 | H01Q 5/00 |

OTHER PUBLICATIONS

Islam et al. ("A Stacked Patch Antenna for Ultrawideband Operation" IEEE International Conference on Ultra-Wideband, 2009. ICUWB Sep. 2009 pp. 654-657).*

(Continued)

*Primary Examiner* — Dameon E Levi
*Assistant Examiner* — Ricardo Magallanes
(74) *Attorney, Agent, or Firm* — Faegre Baker Daniels LLP

(57) ABSTRACT

An ultrawideband antenna for use in communications equipment, comprising a first folded branch antenna element with an electrical connection at a first end and a second folded branch antenna element with an electrical connection at a first end. The folded branch antenna elements are of a triangular shape, or a combination of polygonal shapes. By using the present invention, the volume of an antenna is reduced and the ultra wide bandwidth can be achieved.

14 Claims, 8 Drawing Sheets

(56) References Cited

OTHER PUBLICATIONS

Holub et al. ("A Novel Microstrip Patch Antenna Miniaturization Technique: A Meanderly Folded Shorted-Patch Antenna" 14th Conference on Microwave Techniques COMITE 2008, Prague Apr. 23-24, 2008. p. 2-4).*

Pan ("N Antennas and Their Applications in Portable Handsets" IEEE Trans. on Antennas and Propag. vol. 45, No. 10, Oct. 1997).*

Lee, Jaewon et al., "A Compact Ultrawideband Monopole Antenna for Wireless Communication Application", IEEE Transactions on Antennas and Propagation, IEEE Service, Center, Piscataway, NJ, vol. 57, No. 9, Sep. 1, 2009, pp. 2785-2788, XP011270227, ISSN: 0018-926X.

Delaune, David et al., "Multiband Compact Dual-Art Monopole Antenna Aimed at Mobile Phone Applications", Antenna Technology: Small Antennas and Nobel Metamaterials, 2008, IWAT 2008, International Workshop, IEEE, Piscataway, NJ, Mar. 4, 2008, pp. 366-369, XP031248609, ISBN: 978-1-4244-1522-9.

Islam, Tariqul M. et al., "Design of Compact Ultrawideband Patch Antenna for Wireless Communications". Antenna Technology, 2009, IWAT 2009, IEEE International Workshop, Piscataway, NJ, Mar. 2, 2009, pp. 1-4, XP031452200, ISBN: 978-1-4244-4395-6.

Search Report issued by the European Patent Office, Munich, Germany, dated Jan. 20, 2011, for Priority Application No. EP 10013277.8; 8 pages.

* cited by examiner

ULTRA WIDE BAND ANTENNA

BACKGROUND OF THE INVENTION

1. Field of the Invention

The present invention relates to an ultrawideband antenna device of small dimensions to be used in the communications equipment.

2. Related Art to the Invention

With the success of second generation and third generation wireless communication the fourth generation (4G) or long term evolution (LTE) is now being developed. 4G/LTE mobile communications provide wideband multimedia services at high data rates.

The LTE specification provides downlink peak rates of at least 100 Mbps and an uplink of at least 50 Mbps and RAN round-trip times of less than 10 ms. LTE supports scalable carrier bandwidths from 1.4 MHz to 20 MHz and supports both frequency division duplexing (FDD) and time division duplexing (TDD). The next step for LTE evolution is LTE advanced and is currently being standardized in 3GPP release 10. The standard includes that five different terminal classes have been defined from a voice centric class up to a high end terminal that supports the peak data rates. All terminals will be able to process 20 MHz bandwidths. There is also increased spectrum flexibility with supported spectrum slices as small as 1.4 MHz and as large as 20 MHz. All frequency plans currently used by IMT systems will be used.

One of the research challenges in LTE is the broad frequency range i.e. 698 MHz to 2690 MHz, of the interface between the user equipment (UE) and the eNODE B. If standard half-dipoles or quarter wavelength monopole antennas were to be used, the size of the antenna would be about 21 cm or 10.5 cm for the low frequency range. This would appear too large for the application in the user equipment, mobile phones for example. Moreover, the bandwidths of standard dipole and monopole antennas are too narrow to cover the operating bands of 4G communications.

Different antenna designs have been suggested and used in the past, none of which have an ultrawideband characteristic covering the whole frequency range of 698 MHz to 2690 MHz.

For example, an antenna device in which an antenna element is formed of a linear conductor having two bent portions can be used in which a feeding terminal is disposed at a predetermined position of the antenna element and one end portion of the antenna element is grounded. An antenna device can also have an antenna element that is formed of a linear conductor having four bent portions. In this way, the antenna device can reduce an equipment area since the antenna element of the monopole antenna is bent.

Hence, these are bent monopoles which therefore need less length than straight monopoles. Branch antennas that operate within multiple frequency bands are also being utilized in the hand held radio telephones.

Branch antennas typically include a pair of conductive traces disposed on a substrate that serve as radiating elements and that diverge from a single feed point. The antenna generally includes a flat substrate having a pair of meandering radiating elements disposed thereon. The meandering radiating elements diverge from the feed point that electrically connects the antenna to RF circuitry within a user's equipment. Each of the meandering radiating elements is configured to resonate within a respective frequency band.

Branch antennas may transmit and receive electrical signals within in a band of frequencies that are too narrow for 4G operation. Furthermore, in order to decrease the size of a branch antenna, it is typically necessary to compress the meandering pattern of each radiating element, which typically narrows the frequency band within which the radiating element can operate. To solve this, an antenna including a flat dielectric substrate having a pair of radiating elements, e.g. conductive copper traces disposed in a surface thereof can be used.

The radiating elements branch from an electrical connector to a feed point that electrically connects the antenna to RF circuitry within a user's equipment (UE). Each radiating element has a respective meandering pattern with the respective electrical length that is configured to resonate within a respective frequency band, preferably one high and one low. A preferable material for use of the dielectric substrate is FR4 or polyimide. The dielectric substrate should have a dielectric constant between about 2 and about 4. The size and shape of the dielectric substrate is a tuning parameter. Dimensions of the high and low frequency band radiating elements may vary depending on the space limitations of the substrate surface. The bandwidth of the antenna may be adjusted by changing the shape and configuration of the meandering patterns of the high and low frequency band radiating elements.

In another example of an antenna it is a central principle that different branches of the multiple band antenna are resonant at different frequencies. The antenna branches are connected to a common port for exchanging signals between the antenna branches and the transceiver circuitry of a user's equipment (UE). The first branch is of a length and construction so as to have resonant frequencies in a first band, and the second branch is of a length and construction so as to have resonant frequencies in a second band. The antenna is tuned, for example at the time of manufacture, to an impedance of approximately 50Ω for both bands. Each antenna branch is comprised of a relatively thin flexible dielectric film and a strip antenna formed by a meandering metal line. The metal line can be formed by printing, etching, or other suitable methods. Because the film is a flexible material the printed film can be rolled into a generally cylindrical shape for use as an antenna branch. The cylinder could be partially open or completely closed, depending upon antenna design considerations. For example, the bandwidth of the antenna can be varied by varying the diameter of the cylinder. The meandering metal line is varied between the antenna branches such that the different antenna branches are resonant at different frequencies. Thus multiple resonances and multiple branches can be achieved by selecting appropriate strip dimensions and patterns for each branch. The antenna branches are similar to monopole antennas.

Unfortunately, branch antennas may transmit and receive electrical signals within a band of frequencies that is too narrow to satisfy the needs of LTE and 4G or that hardly has the margin to take into account the surrounds of a UE. Furthermore, in order to decrease the size of hand antenna, it is typically necessary to compress the meandering pattern of a radiating element.

Unfortunately, as the meandering pattern of a radiating element becomes more compressed, the frequency band within which the radiating element can operate typically becomes narrower.

Thus, in light of the demand for ultra wideband UEs and the problem with conventional antennas for such mobile communications equipment, a need exists for smaller UWB antennas that are capable of operating in the LTE/4G frequency range.

Furthermore, in recent years the usage of antennas in other fields than mobile communications has also increased. For example, there is an increasing need for antennas in the industrial field for, among others, machine to machine communication or in the medical device field for, among others, patient monitoring. Demand has also increased for antennas in the field of home appliances in the pursuit of home automation.

It follows that an antenna with improved wideband frequency characteristics and compact size is not only desired for mobile communication equipment, but also for non-mobile equipment.

SUMMARY OF INVENTION

It is therefore an objection of the present invention to provide small antennas for wireless communication equipment that are ultra wideband. This object is solved by the invention as claimed in the independent claims. Preferred embodiments of the invention are defined by the dependent claims.

Communications equipment in the sense of the present invention refers to either mobile equipment, such as user equipment (UE), mobile phone, mobile hand-held device, wireless modem for a laptop computer, laptop computer, vacuum cleaner, etc, or non-mobile equipment, such as industrial machines, home appliances, medical devices, etc. Hence, non-mobile equipment in the sense of the present invention refers to a device which is normally not intended to be carried and/or moved around by the user, i.e. it is usually a stationary device. In the field of home appliances, a coffee machine or a refrigerator are examples of non-mobile equipment in the sense of the present invention.

Having an ultrawideband antenna for use in a communications equipment that comprises a first folded branch antenna element with an electrical connection at a first end and a second folded branch antenna element with an electrical connection at a first end has the advantage of having a small size antenna of ultrawide bandwidth.

In an advantageous embodiment the first and second folded branch antenna elements increase in width from the first end to a second end, as this increases bandwidth of the antenna.

In a further embodiment the first and second folded branch antenna elements are of a triangular shape or of a combination of triangular, rectangular or polygonal shapes, which makes it easier to determine the bandwidth of the antenna.

In a further advantageous embodiment the first and second folded branch antenna elements are Vivaldi antennas making them straightforward to manufacture as an ultrawideband antenna.

In a further embodiment the first and second folded branch antenna elements are of different lengths, which have the advantage of increasing the bandwidth of the antenna.

In a further advantageous embodiment the first folded branch antenna element is tuned to a first frequency band and the second folded branch antenna element is tuned to a second frequency band, both frequency bands being within 698 MHz to 2690 MHz, which makes the ultrawideband antenna usable for LTE/4G.

In another advantageous embodiment of the invention the first and second folded branch antenna elements are made of a conductive metal, preferably copper or silver, so they have advantageous radiating properties.

In a further advantageous embodiment the first and second folded branch antenna elements are connected electrically to a Printed Circuit Board (PCB) or to a chassis of the mobile communications equipment. The antenna can either be directly in contact with the PCB as such, for example, via an RF input/output of the PCB, or indirectly via, for example, an RF input/output mounted on the chassis (grounding) of the communications equipment.

Having a dielectric element located between the first and second folded branch elements has the advantage that the ultrawideband antenna can be made even smaller. Similarly, having a dielectric element located between the first end and the second end of the second folded branch antenna element, therefore in the loop created by the second folded branch antenna element, also has the effect of making the ultrawideband antenna smaller in size.

In a further advantageous embodiment of the invention the first and second folded branch antenna elements are wrapped around the dielectric element or printed on the dielectric element improving the antenna's mechanical stability.

In a further advantageous embodiment of the invention the first folded branch antenna element is folded twice at 90°, and the second folded branch antenna element is folded three times at 90° each, which makes the ultrawideband antenna smaller in size.

Having the second end of the second folded branch antenna element electrically shorted with itself and creating a loop has the advantage of further reducing the size of the ultrawideband antenna.

Having a third folded branch antenna element with an electrical connection at a first end in the ultrawideband antenna has the advantage of being able to improve the VSWR further, or increasing the bandwidth.

In a further advantageous embodiment of the invention a method of manufacturing an ultrawideband antenna comprises the steps of printing a conductive metal of a first folded branch antenna element onto three sides of a dielectric element and printing a conductive metal of the second folded branch antenna element onto four sides of the dielectric element.

DETAILED DESCRIPTION OF THE INVENTION

Figure 1:
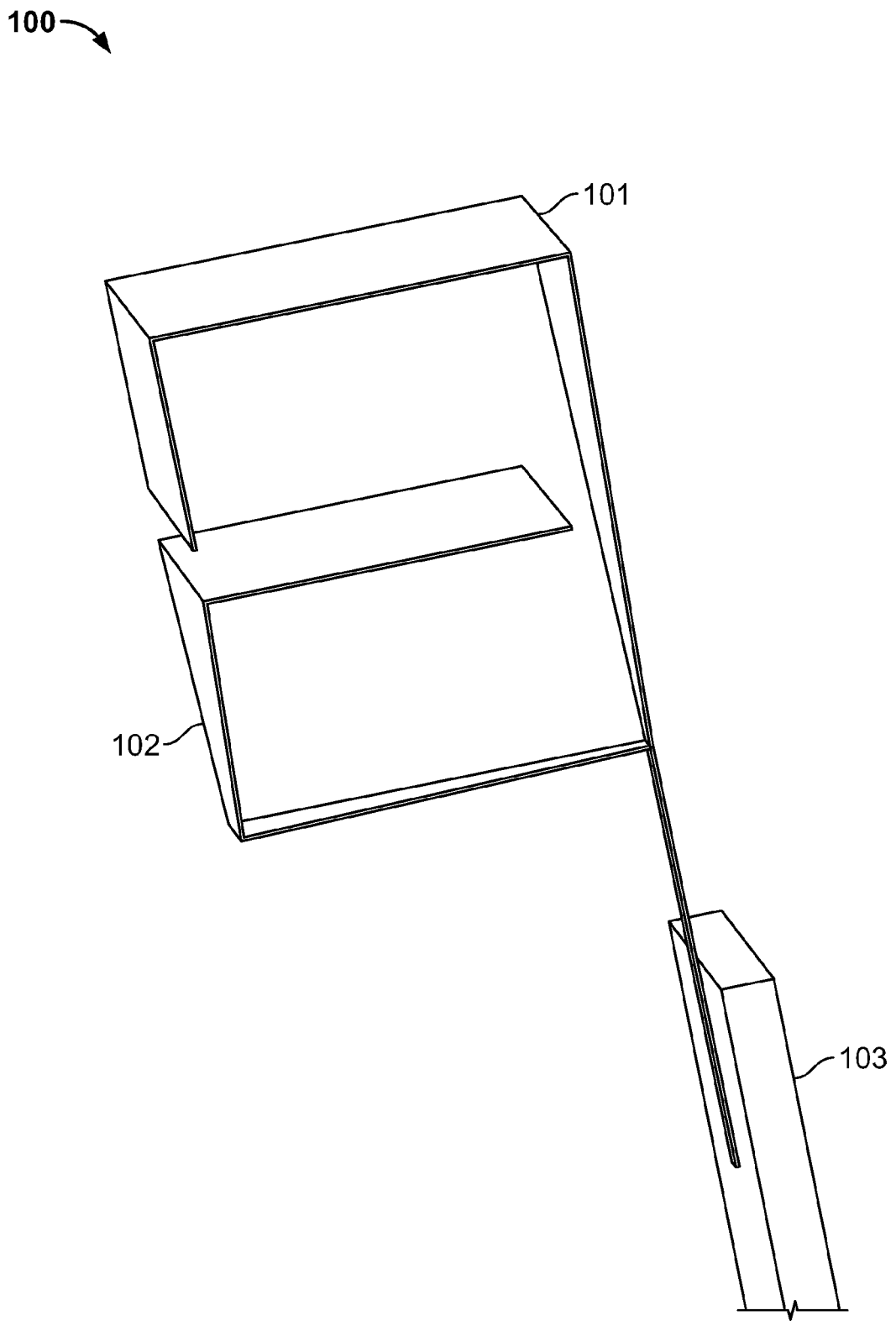
FIG. 1 shows a two-branch antenna with antenna elements of triangular shape.

Herein a more detailed description based on embodiments of the present invention with reference to the accompanying drawings is provided.

First, a preferred embodiment will be described. However, the present invention should not be construed as limited to the embodiments set forth herein. Rather these embodiments are provided so that this disclosure will be thorough and complete and will fully convey the scope of the invention to those skilled in the art. In the drawings like numbers refer to like elements throughout.

In particular, the antenna of this preferred embodiment is described in the context of being used in a mobile communication equipment in an LTE or 4G network. It is, however, conceivable that small ultra wideband antennas could be used in many different circumstances, including fixed wireless access, WLAN, WiFi, etc.

Throughout the following description, the two-branch antenna is described as being used in a mobile communications equipment which could be a user equipment (UE), mobile phone, mobile handheld device, wireless modem for a laptop computer, etc. The antenna could, however, also be used in non-mobile devices, such as home appliances, industrial machines, medical devices, etc.

As described earlier, folded dipoles and monopoles are known in the art for reducing the size of the antennas needed in user equipments or mobile devices. As explained, in the environment of LTE and 4G the bandwidth provided by these dipoles and monopoles would not be sufficient. To achieve the wide bandwidth necessary, i.e. from 698 MHz to 2690 MHz, LTE triangular shaped antennas or Vivaldi antennas are used in this invention. If they were employed in the conventional way, there would again be a size problem as these ultrawideband antennas would not fit into the UE or mobile device.

Broadband operation is becoming increasingly popular in several practical applications including next generation wireless terminals. Broadband antennas that are small in size and simple in structure are typically preferred for such applications. Microstrip patch antennas are sometimes used for wireless communication systems as they are of small size, light weight, low profile, low cost, and they are easy to fabricate and assemble.

A Vivaldi antenna looks like a two-dimensional horn printed on circuit board, i.e. the electrically conducting metal on the circuit board widens toward the aperture bounded by two exponential patterns. The feed is of the opposite side of the aperture. Triangular antennas can come in different sizes as the angle of the vertices of the triangle can be varied. Sometimes equilateral triangles are used. Again the end with the wide aperture is the radiating side and the tip of the triangle will be fed.

In this way, the broadband characteristics of the Vivaldi and triangular antennas are used while keeping the dimensions of the antenna small. This is achieved by folding the antenna elements.

As is known, an antenna is a device for transmitting and/or receiving electrical signals. A transmitting antenna typically includes the feed assembly that induces or illuminates an aperture or a reflecting surface to radiate an electromagnetic field. A receiving antenna typically includes an aperture or surface focusing an incident radiation field to a collecting feed producing an electronic signal proportion to the incident radiation.

Voltage standing wave radio (VSWR) relates to the impedance match of an antenna feed point with a feed line or transmission line of a communications device such as a UE. To radiate radio frequency (RF) energy with minimum loss or to pass along received RF energy to a UE receiver with minimum loss, the impedance of the UE antenna is conventionally matched to the impedance of a transmission line or feed point.

Conventional UEs typically employ an antenna that is electrically connected to a transceiver that is connected to a signal processing circuit on an internal PCB. In order to maximize power transferred between an antenna and a transceiver, they are interconnected such that their respective impedances are substantially matched, i.e. electronically tuned to provide a 50Ω impedance value at the feed point.

FIG. 1 shows a two branch antenna 100 of triangular shape. First branch antenna element 101 and second branch antenna element 102 are connected to ground 103, which is preferably a PCB board. The two branch antenna 100 is preferably made of conducting metal and joined to ground, i.e. the PCB board, by a metal strip. The antenna is quite narrow between ground and the branching point, from where on the two-branch antenna elements 101 and 102 are of a two-dimensional triangular shape. Both branch antenna elements 101 and 102 are folded twice.

The first branch antenna element 101 is in continuation from ground 103 until the first fold at 90°. The second fold is at another 90° in the same direction. The first fold of the second branch antenna element 102 occurs before the first fold of the first branch antenna element 101 and branches out in the direction of the first fold of branch antenna element 101. The first fold of the second branch antenna element 102 is at 90° to the first part of second branch antenna element 102, which then renders it parallel to the first part of the first branch antenna element 101. The second fold of second branch antenna element 102 is again at 90° to the second part of the second branch antenna element 102, so that the third part of the second branch antenna element 102 is parallel to the second part of the first branch antenna element 101.

Figure 2:
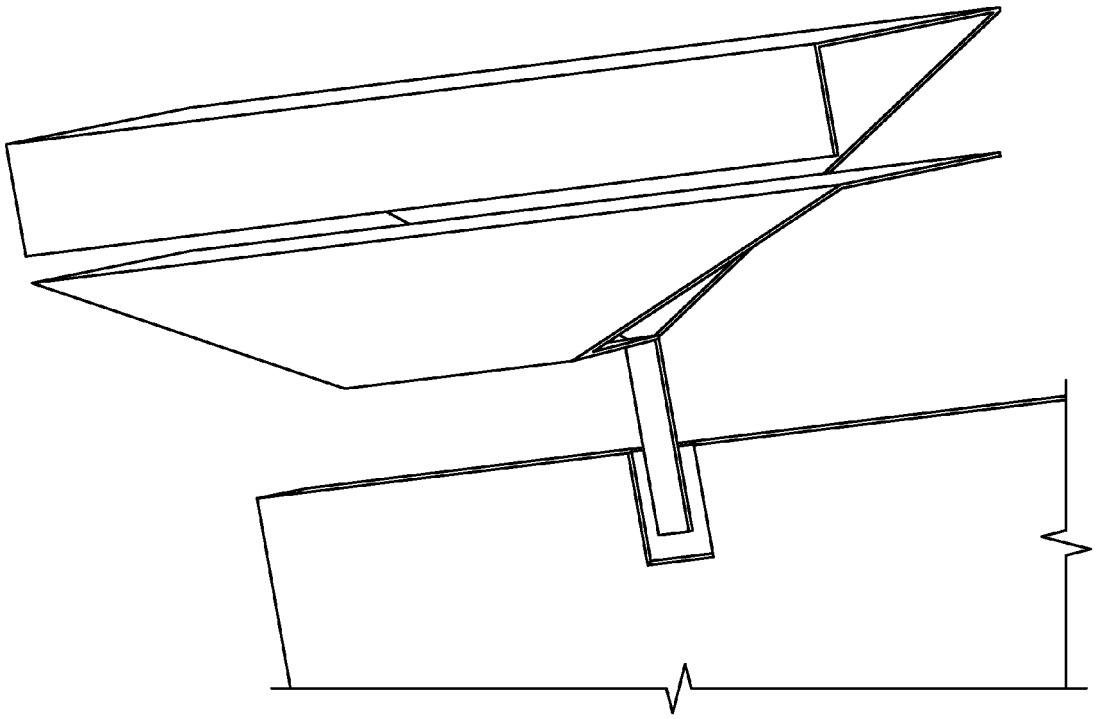
FIG. 2 shows another view of the two-branch antenna of FIG. 1.

FIG. 2 is another view of the antenna 100 of FIG. 1, showing more clearly how the two-branch antenna 100 is fixed to the PCB board 103 and how the folded branch antenna elements 101 and 102 are of triangular shape.

Having two folded elements in the two branch antenna increases the bandwidth of the ultrawideband antenna even further and makes it possible to cover the lower band of the LTE and as well as the higher end of the LTE band in one single antenna. This means that each branch can be designed and tuned that the VSWR is still acceptable for operation within a mobile communications device, while having an ultrawide bandwidth for the whole of the antenna (100).

Figure 3:
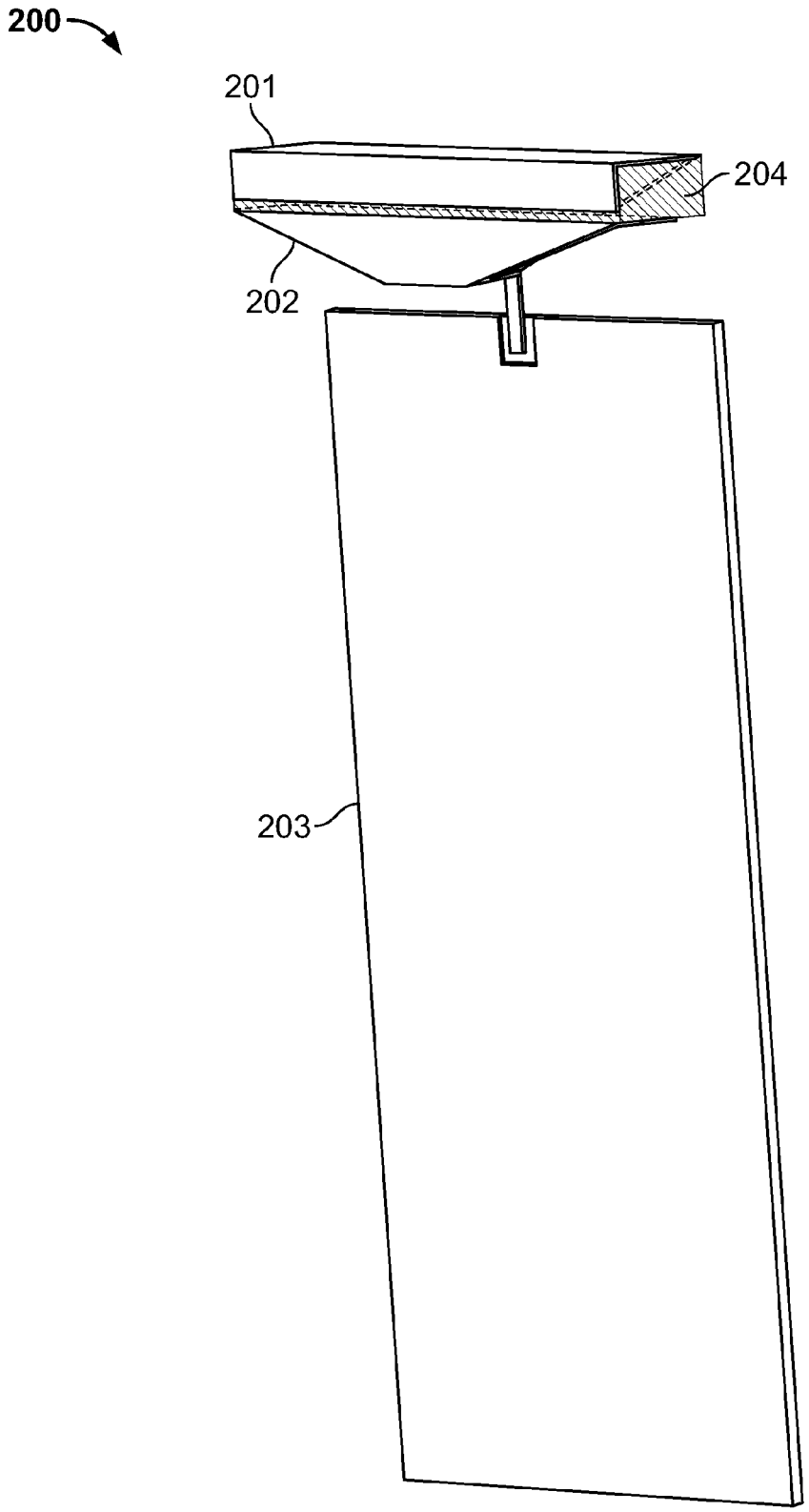
FIG. 3 shows a two-branch antenna with a dielectric element.

As can be seen in FIG. 3 a dielectric slab 204 can be used between a first branch antenna element 201 and second branch 202 of alternative embodiment two branch antenna 200. Adding dielectric material enables the antenna to be made even smaller for the same frequency band. Additionally, having a dielectric slab in between the two branch antenna elements improves the stability of the antenna. It also allows for a manufacturing process that includes winding the two branch antenna elements around the dielectric slab or having the two branch antenna elements printed onto the dielectric slab.

A dielectric element can also be inserted in the loop that is formed by the second folded branch antenna 202.

The size of the antenna 100 and the alternative embodiment antenna 200, as described above, is 50 mm×10 mm×8 mm, whereby the thickness of the dielectric slab 204 is 5 mm the size of the ground plate/PCB board is 50 mm×100 mm, typically.

Figure 4:
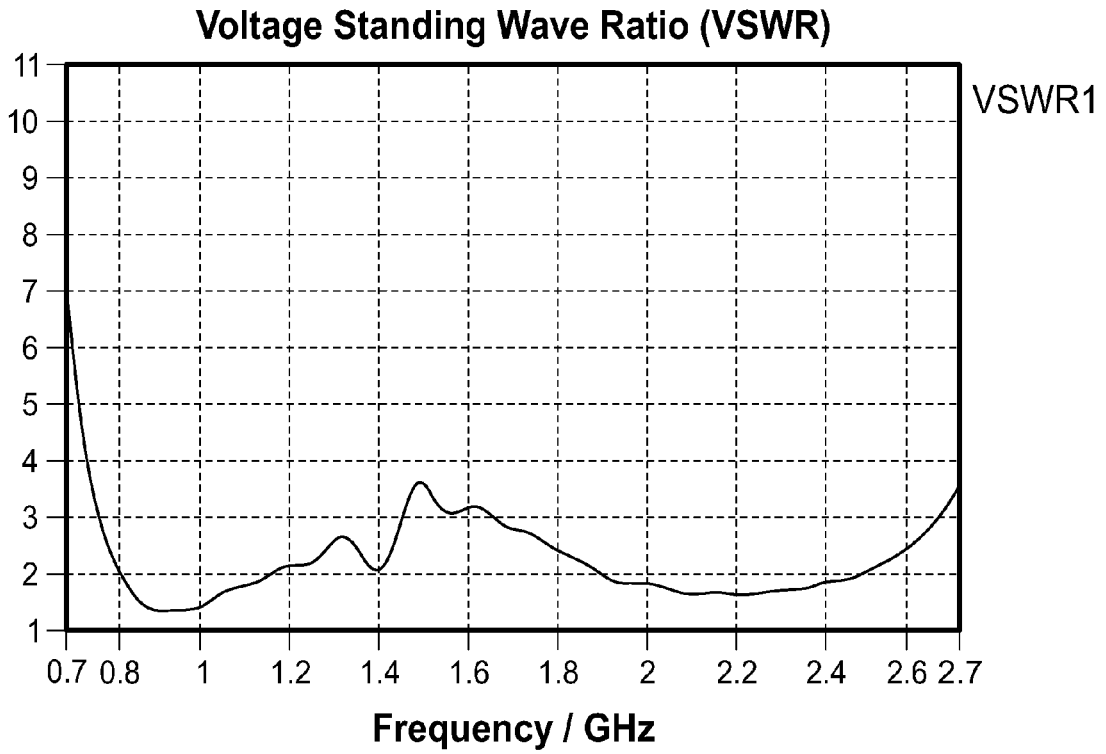
FIG. 4 shows the VSWR of the antenna in FIG. 3 mounted in a device.

FIG. 4 shows the voltage standing wave ratio (VSWR) of the antenna of FIG. 3 when it is mounted in a device. The VSWR is shown in the relevant frequency range for LTE, 698 MHz to 2690 MHz. As can be seen in FIG. 4, the VSWR across the whole frequency range of interest is acceptable for use in a mobile communications device.

Figure 5:
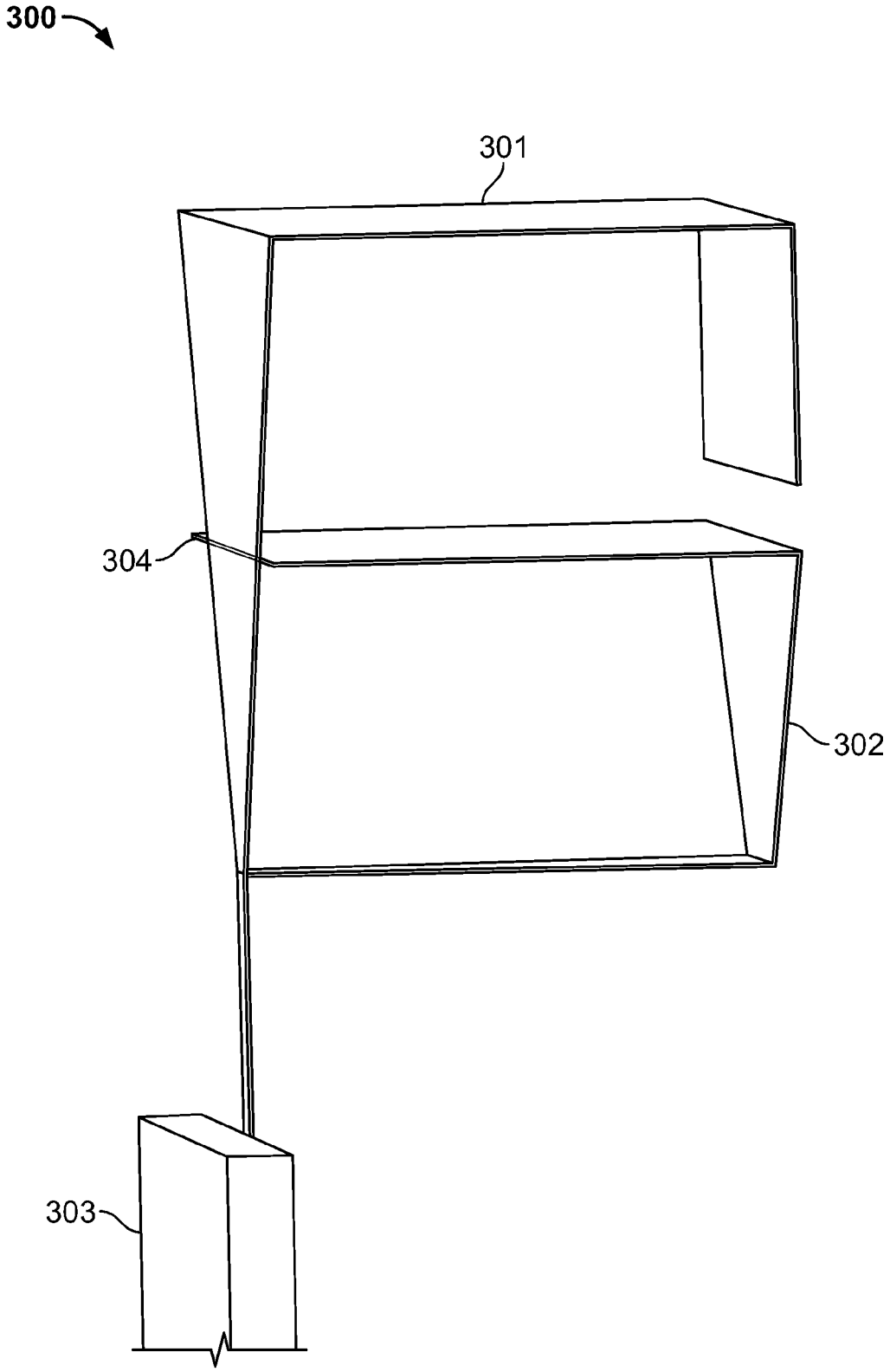
FIG. 5 shows a shorted two-branch antenna of triangular shape.

FIG. 5 shows a shorted two branch antenna of triangular shape (300). The two branches are connected at one end to ground/PCP board (303) and from the branch point onwards gain in width. In case of the first branch antenna element (301), in this particular case it is folded after the triangular portion and turns into a rectangular portion, which is then again folded. The second branch antenna element (302) is of triangular shape as well and is folded while it still increases in width, the second fold coming at the end of the triangular shape. After the second fold the second branch antenna element is of a rectangular shape. The second end of the second branch antenna element (302) has an electrical connection (304) with the triangular part of the first branch antenna element (301), therefore creating a short.

Figure 6:
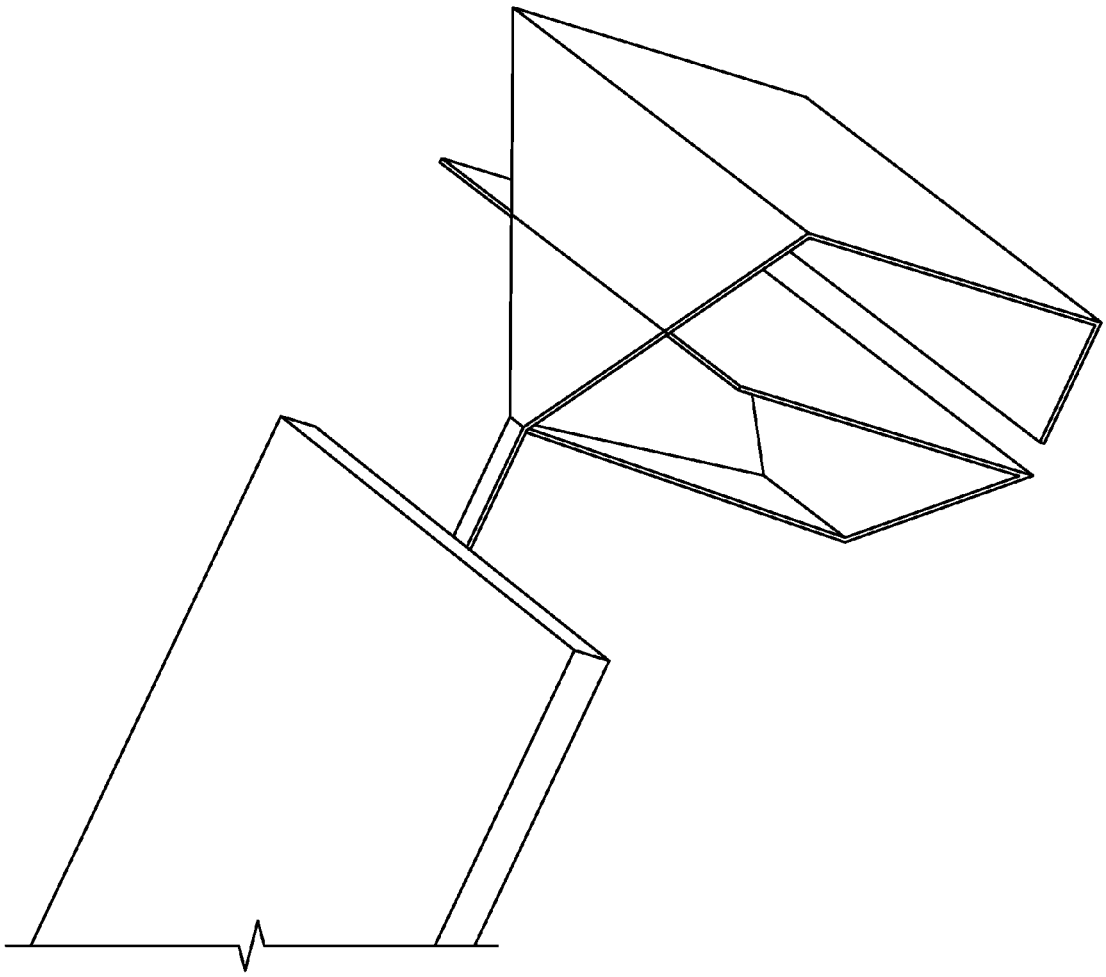
FIG. 6 shows another view of the antenna of FIG. 5.

FIG. 6 shows another view of the antenna of FIG. 5, in which it is more clearly shown that the second end of the second branch antenna element (302) is electrically connected to the triangular part of the first branch antenna element (301). This short connection occurs at about half of the height of the triangular part of the first branch antenna element (301).

As can be seen in FIGS. 5 and 6, the second branch antenna element (302) creates a loop thanks to the short connection (304).

Figure 8:
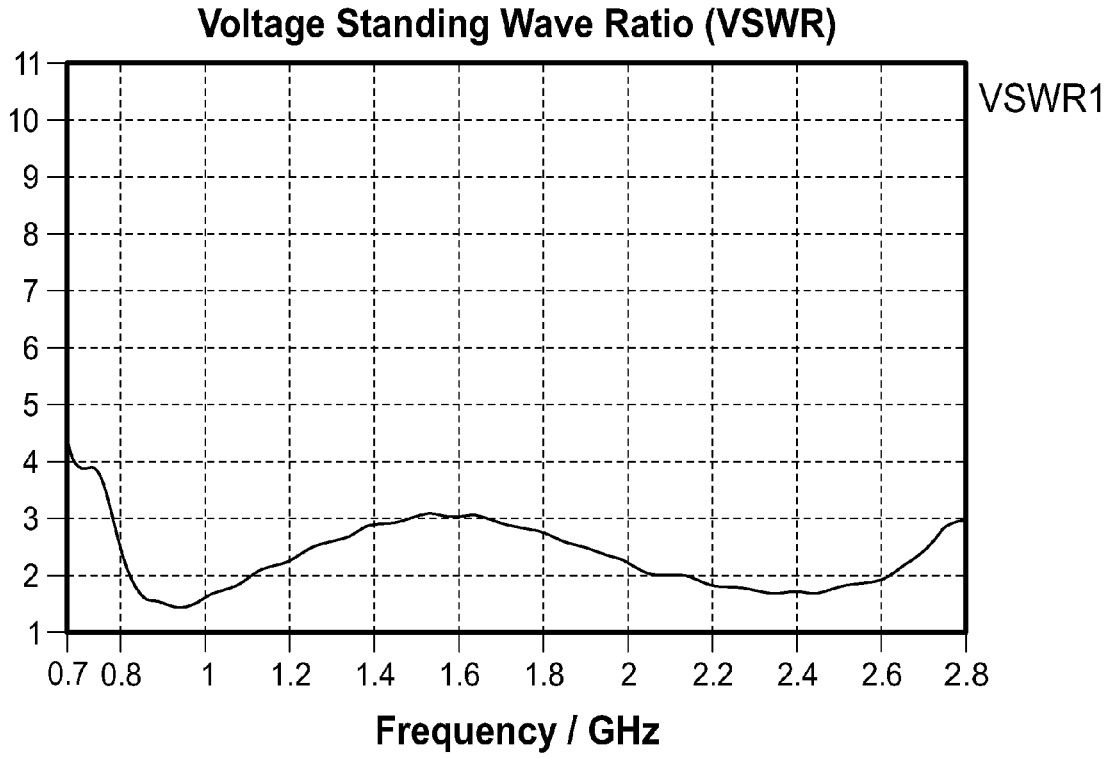
FIG. 8 shows the VSWR of the antenna of FIG. 7 mounted in a device.

As can be seen in FIG. 8, when compared to FIG. 4, this results in an improved VSWR of the antenna.

Figure 7:
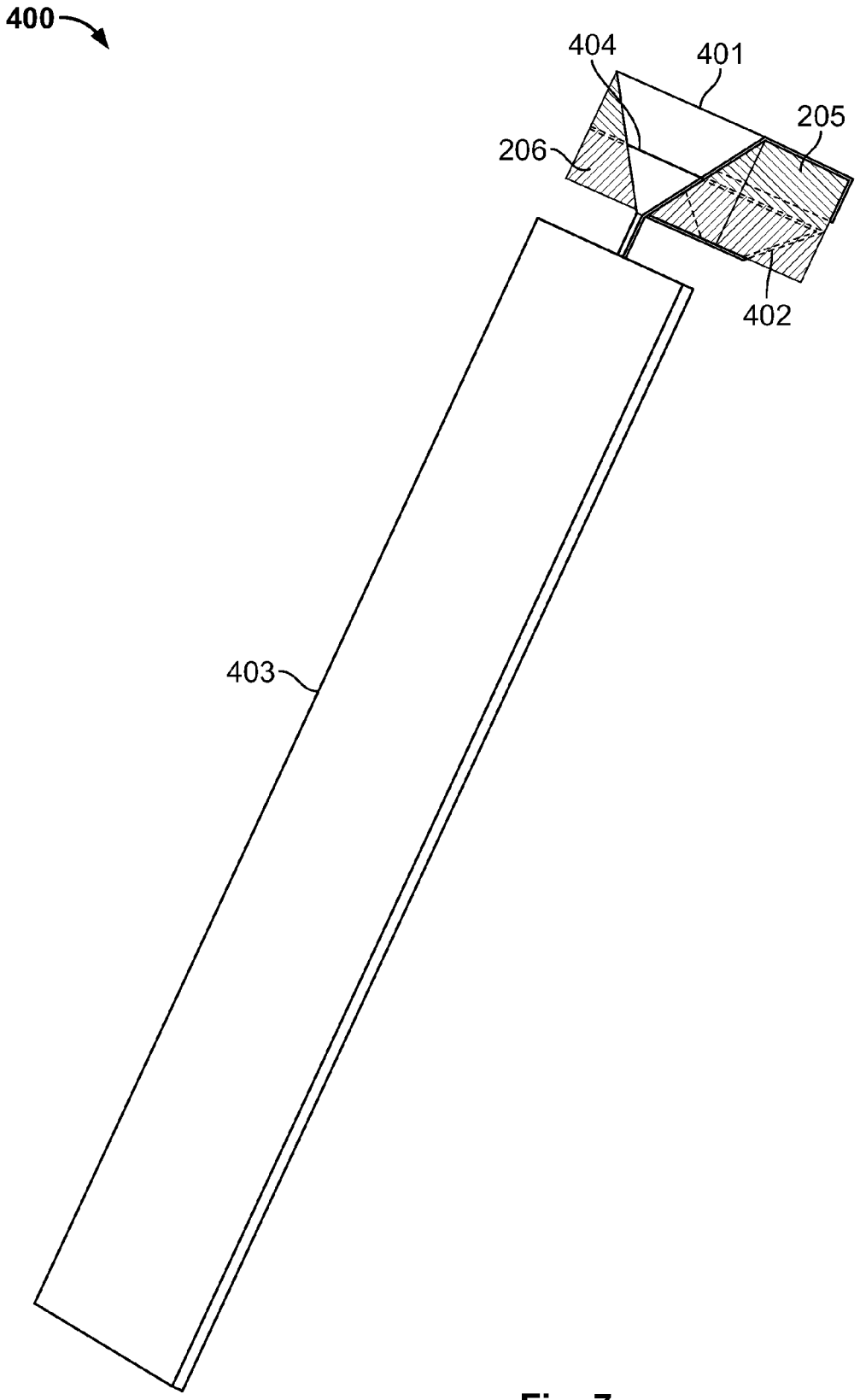
FIG. 7 shows the shorted two-branch antenna with two dielectric elements.

FIG. 7 shows an alternative embodiment shorted two branch antenna (400) with two dielectric slabs inserted between a first branch antenna element (401) and a second branch antenna element (402) and within a folded loop of the second branch antenna element (402). These dielectric slabs (205, 206) are optional features that lower the frequency response of the antenna. The first branch (401) and second branch (402) antenna elements are ultrawide band antenna elements of a Vivaldi shape or a triangular shape and are connected at one end to ground/PCB board (403). In this embodiment the second branch antenna element (402) is shorted to itself, so the second end connects with the first end, thereby creating a loop.

Typical parameters of the antenna (400) of FIG. 7 are for the size of the antenna 50×10×8 mm, for the thickness of the dielectrics 5 mm and for the size of the ground plate 50×100 mm.

FIG. 8 shows the voltage summing ratio (VSWR) of the antenna in FIG. 7 when it is mounted in a device. Here it can be seen that the VSWR is reasonable in the frequency range used by LTE/4G.

The invention claimed is:

1. An ultrawideband antenna for use in communications equipment, comprising:

a first folded branch antenna element having a first portion, a second portion coupled to the first portion of the first folded branch antenna element, and a third portion coupled to the second portion of the first folded branch antenna element, with a first end defined on the first portion of the first folded branch antenna element and a second end defined on the third portion of the first folded branch antenna, and a first side of the first portion of the first folded branch antenna element includes the first end and a second side of the first portion includes the first end and faces opposite the first side, and the second side of the first portion of the first folded branch antenna element is configured to be electrically connected to a ground element at the first end, and the first side being spaced apart from the ground element; and a second folded branch antenna element having a first portion, a second portion coupled to the first portion of the second folded branch antenna element coplanar with the second end of the first folded branch antenna, and a third portion coupled to the second portion of the second folded branch antenna element, with a first end defined on the first portion of the second folded branch antenna element and a second end of the second folded branch antenna element defined on the third portion of the second folded branch antenna element, the first end of the second folded branch antenna element being electrically connected to the first side of the first portion of the first folded branch antenna element, and the second end of the second folded branch antenna element being electrically shorted with the first side of the first portion of the first folded branch antenna element.

2. The ultrawideband antenna of claim 1, wherein the first and second folded branch antenna elements increase in width from the first end to a second end.

3. The ultrawideband antenna of claim 1, wherein the first and second folded branch antenna elements are of a triangular shape, or of a combination of triangular, rectangular and polygonal shapes.

4. The ultrawideband antenna of claim 1, wherein the first and second folded branch antenna elements are of different lengths.

5. The ultrawideband antenna of claim 1, wherein the first folded branch antenna element is tuned to a first frequency band and the second folded branch antenna element is tuned to a second frequency band, both frequency bands being within 698 MHz to 2690 MHz.

6. The ultrawideband antenna of claim 1, wherein the first and second folded branch antenna elements are made of a conductive metal.

7. The ultrawideband antenna of claim 1, wherein the first and second folded branch antenna elements are connected electrically to a Printed Circuit Board or to a chassis of the mobile communications equipment.

8. The ultrawideband antenna of claim 1, further comprising a dielectric element located between the first and second folded branch antenna elements.

9. The ultrawideband antenna of claim 1, further comprising a dielectric element located between the first end and the second end of the second folded branch antenna element.

10. The ultrawideband antenna of claim 8, wherein the first and second folded branch antenna elements are wrapped around the dielectric element or printed on the dielectric element.

11. The ultrawideband antenna of claim 1, wherein the first folded branch antenna element is folded twice at 90° and the second folded branch antenna element is folded three times at 90° each.

12. The ultrawideband antenna of claim 1, wherein the second folded branch antenna element includes a first folded side, a second folded side, and a third folded side with an electrical connection at a first end.

13. A method of manufacturing an ultrawideband antenna for use in mobile communications equipment comprising the steps of:

providing a ground element;

providing a first folded branch antenna element with a first portion having a first side and a second side facing opposite the first side, and the first side being spaced apart from the ground element, the first portion also including a first end of the first folded branch antenna element, a second portion coupled to the first portion of the first folded branch antenna element, and a third portion including a second end of the first folded branch antenna element;

electrically coupling the second side of the first end of the first folded branch antenna element to the ground element;

providing a second folded branch antenna element with a first portion including a first end of the second folded branch antenna element, a second portion coupled to the first portion of the second folded branch antenna element and coplanar with the second end of the first folded branch antenna element, and a third portion including a second end of the second folded branch antenna element;

electrically coupling the first end and the second end of the second folded branch antenna element to the first side of the first portion of the first folded branch antenna element;

printing a conductive metal of the first folded branch antenna element onto three sides of a first dielectric element, and printing a conductive metal of the second folded branch antenna element onto four sides of a second dielectric element.

14. The ultrawideband antenna of claim 6, wherein the conductive metal is at least one of copper and silver.

* * * * *